United States Patent [19]

Sawada

[11] Patent Number: 4,534,664

[45] Date of Patent: Aug. 13, 1985

[54] PRINTING MECHANISM HAVING A PLURALITY OF TYPE PLATES

[75] Inventor: Kazuyoshi Sawada, Kashiwazaki, Japan

[73] Assignee: Silver Seiko Ltd., Japan

[21] Appl. No.: 487,694

[22] Filed: Apr. 22, 1983

[30] Foreign Application Priority Data

Apr. 26, 1982 [JP] Japan ..... 57-68738

[51] Int. Cl.[3] ..... B41J 7/54; B41J 7/50

[52] U.S. Cl. ..... 400/110; 400/144; 400/175; 400/335; 400/484; 400/534

[58] Field of Search ..... 400/110, 139, 140, 141, 400/141.1, 144, 144.2, 149, 150, 151, 162.1, 171, 174, 175, 154.2, 172, 335, 484, 534; 101/93.11, 93.12, 93.38, 93.39, 93.40; 206/454, 455, 456; 353/115, 116; 178/30

[56] References Cited

U.S. PATENT DOCUMENTS

| | | | |
|---|---|---|---|
| 410,629 | 9/1889 | Arnold | 400/169 X |
| 2,757,775 | 8/1956 | Hickerson | 400/154.2 |
| 2,900,074 | 8/1959 | Windman | 206/456 |
| 3,187,890 | 6/1965 | Brown | 206/456 |
| 3,334,720 | 8/1967 | Hickerson | 400/144 X |
| 3,397,766 | 8/1968 | Spalinger et al. | 400/144 |
| 3,419,124 | 12/1968 | Sawaki | 400/141.1 |
| 3,709,358 | 1/1973 | Andrews et al. | 206/454 X |
| 3,809,203 | 5/1974 | Ogawa et al. | 400/484 X |
| 3,872,960 | 3/1975 | Gabor | 400/335 |
| 4,043,451 | 8/1977 | Johnson | 206/454 X |
| 4,061,228 | 12/1977 | Johnson | 206/455 X |
| 4,144,405 | 3/1979 | Wakamatsu | 400/110 X |
| 4,357,115 | 11/1982 | Or | 400/144.2 X |
| 4,406,552 | 9/1983 | Chervendinev et al. | 400/172 |

FOREIGN PATENT DOCUMENTS

| | | | |
|---|---|---|---|
| 26083 | 4/1976 | Japan | 400/171 |
| 0093155 | 6/1982 | Japan | 400/144 |
| 0093156 | 6/1982 | Japan | 400/110 |
| 0093157 | 6/1982 | Japan | 400/144 |
| 0093158 | 6/1982 | Japan | 400/144 |
| 0093178 | 6/1982 | Japan | 400/144 |
| 0093179 | 6/1982 | Japan | 400/144 |
| 49690 | 4/1983 | Japan | 400/171 |
| 49691 | 4/1983 | Japan | 400/171 |
| 1995 | of 1905 | United Kingdom | 400/141 |

*Primary Examiner*—Ernest T. Wright, Jr.

*Attorney, Agent, or Firm*—Lane, Aitken & Kananen

[57] ABSTRACT

An impact printing mechanism which contains a great number of printing types in a minimized spacing is disclosed. Types are arranged in rows of columns on a plurality of substantially planar type carrying elements which are accommodated in equally spaced parallel relationship in a removable casing. Selection of a type is attained by three dimensional movements including horizontal movements of the elements within and perpendicular to their planes and a vertical movement of an element within its plane.

The type carrying elements are carried on a carrier while a print hammer is mounted on an independent carrier. The former carrier includes an outer section and an inner section mounted for movement on the outer section, and means for lifting a type carrying element is mounted on the outer section.

15 Claims, 12 Drawing Figures

PRINTING MECHANISM HAVING A PLURALITY OF TYPE PLATES

BACKGROUND OF THE INVENTION

This invention relates to an impact printing mechanism, and more particularly to an impact printing mechanism wherein a plurality of type plates are employed which each carry thereon a number of types arranged in rows and columns.

Typewriters are already known in which a great number, for example, thousands, of character types are incorporated. Typically, a conventional Japanese typewriter including kanas, kanjis, alphabets, numerals, symbols and so on. Such types are formed into individual type pieces or blocks and accommodated in rows and columns in a type box mounted for movement within a type accommodating plane to bring a selected type block to a particular position so that the type block may then be picked up and struck by a single type bar against a platen. Such type blocks are normally made of a type metal, resulting in significant weight of the machine. Besides, the machine must always be held in a horizontal position, since otherwise some or all of the types in the machine will drop from the type box.

A printing mechanism which eliminates these defects has been already proposed in a Japanese patent publication No. 51-26083. This prior art mechanism includes a set of type plates which each have a plurality of character types arranged in rows and columns thereon and are disposed in parallel relationship to one another and to a platen. A desired type is thus selected by three dimensional motions including a first motion of the type plate set in a first horizontal direction perpendicular to the planes of the type plates below the platen to bring a particular type plate containing the desired character type to a predetermined plane (i.e., selection of a type plate), a second horizontal motion of the type plate set in a second horizontal direction parallel to the platen to bring a type column including the desired type to a particular lateral position opposing a print hammer (i.e., selection of a type column), and a third vertical motion of the type plate within the predetermined plane to bring a type row containing the desired type to a position level with the print hammer (i.e., selection of a type row) thereby to finally position the desired character type in position in alignment or register with the print hammer to allow the type to be thereafter struck by the print hammer for effecting printing of the character. However, while a concept of such an arrangement is disclosed in the patent publication, it totally fails to disclose a practical structure for mounting type plates and a mechanism for selecting a character type from a number of characters on a set of type plates.

SUMMARY OF THE INVENTION

Accordingly, it is an object of the present invention to provide a new and efficient printing mechanism wherein a number of fonts can be printed which are contained in one lot therein.

It is another object of the invention to provide a printing mechanism which can be suitably applied to a typewriter or printer, such as a Japanese language typewriter, which is required to include a great number of character types therein.

It is a further object of the invention to provide a printing mechanism which overcomes such problems of conventional printing mechanisms as described above and attains accurate and smooth selection of a desired character type from a number of character types.

Other objects and advantages of the present invention will become apparent from the following detailed description and accompanying drawing of a preferred embodiment of the invention.

DETAILED DESCRIPTION OF THE INVENTION

Figure 1:
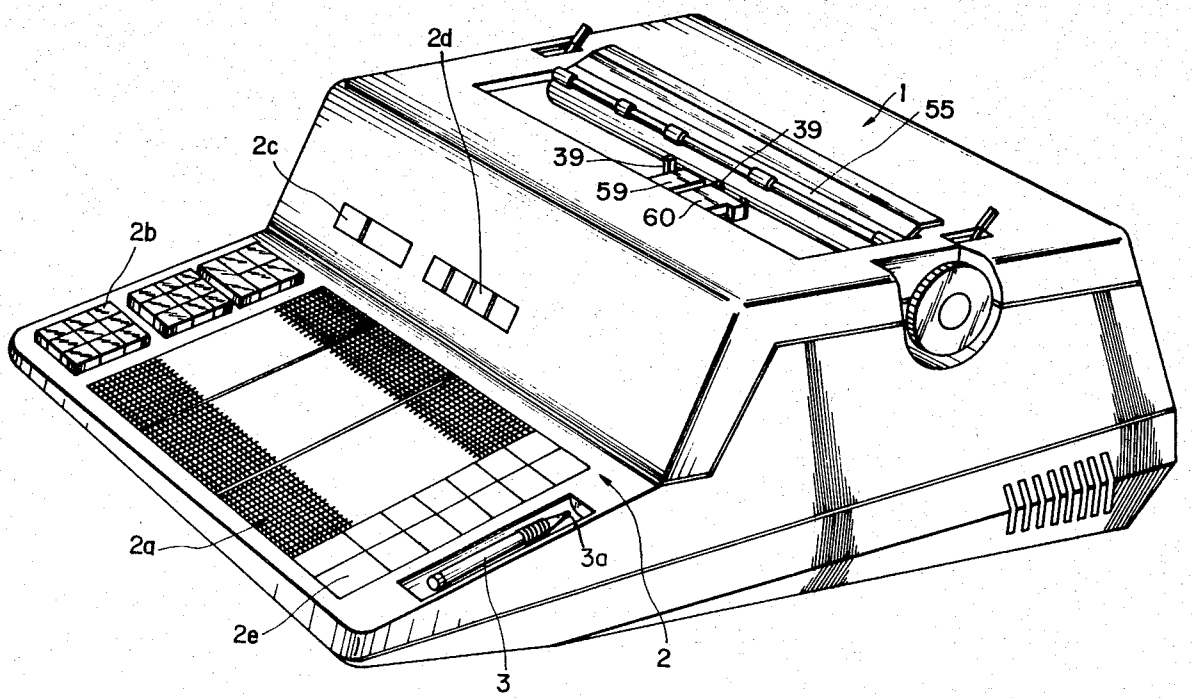
FIG. 1 is a perspective view of a typewriter employing a printing mechanism according to the present invention.

Referring first to FIG. 1, there is illustrated a Japanese electronic typewriter or word processor which employs a printing mechanism according to the present invention. The typewriter has a printer section 1 at its rear part and a keyboard console 2 at its front part. The console 2 includes a well known tablet input device **2*a* on which various characters such as alphanumeric characters, kanjis and kanas, numerals, symbols, etc., are represented in rows and columns in order that information may be inputted by touching or pressing a portion of a desired character with a pointed end, for example, of a touch pen 3. The touch pen 3 may be placed on a recess 3*a* formed at a right-hand end portion of the console 2 when not in use. The console 2 further includes a group of function keys 2*b*, liquid crystal display devices 2*c* and 2*d*, and an additional tablet input section 2*e*** for inputting some different function information; these are well known in the art and hence detailed description is omitted. But it is to be mentioned that it is alternative to employ a different input type such as a conventional alphanumeric keyboard.

Figure 2:
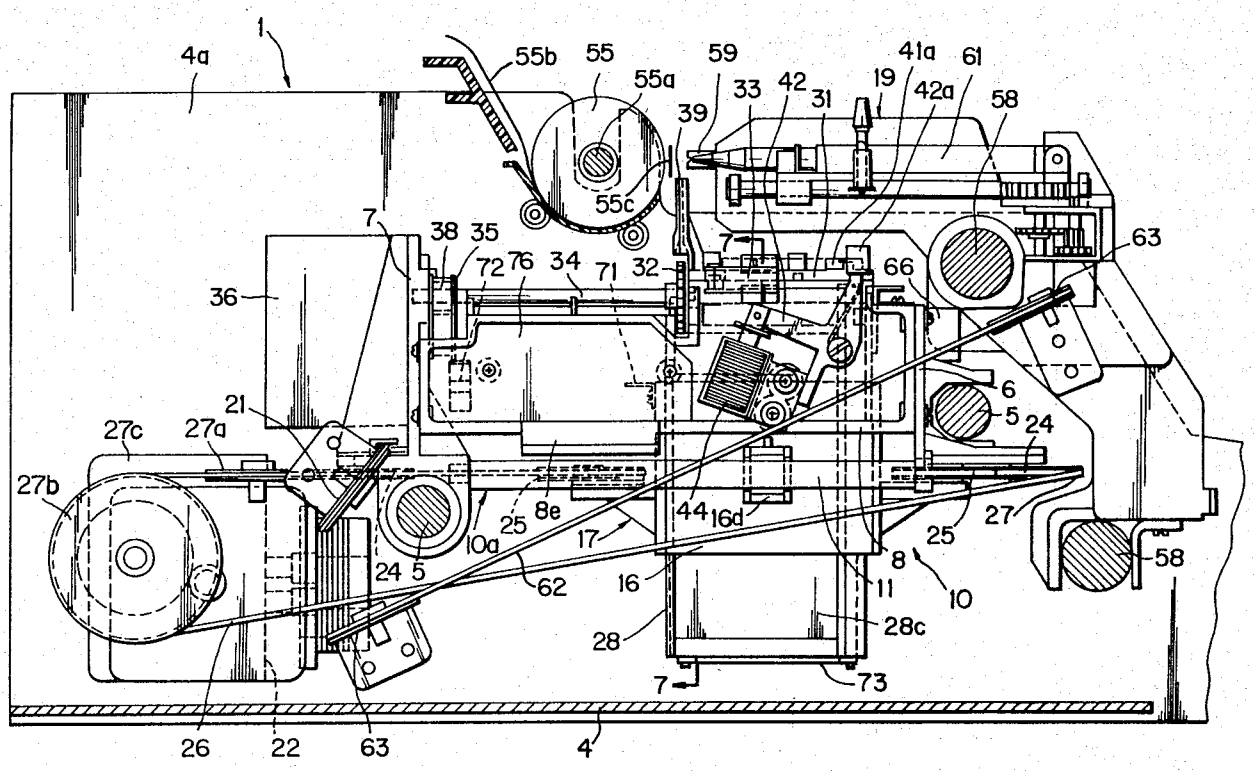
FIG. 2 is a side elevational sectional view of the printing mechanism.

Referring now to FIG. 2, the printer section 1 has two separate carrier members including a hammer carrier, generally designated at 19, on which a print hammer 59 is carried, and a type carrier, generally designated at 10, on which a plurality of type carrying elements TC are carried. Thus, a selected character type 29' of a selected type carrying element TC is brought to a print position and is struck by the hammer 59 against a record medium 55*b* supported on a platen 55 with an ink ribbon 55*c* lifted between the character type 29Δ and the record medium 55*b* for printing of the character on the medium 55*b*. The hammer carrier 19 and the type carrier 10 are mounted for individual movement in parallel relationship to a print line on the platen 55 so that characters or symbols can be printed successively on a record medium 55*b* supported on the platen 55.

Figure 9:
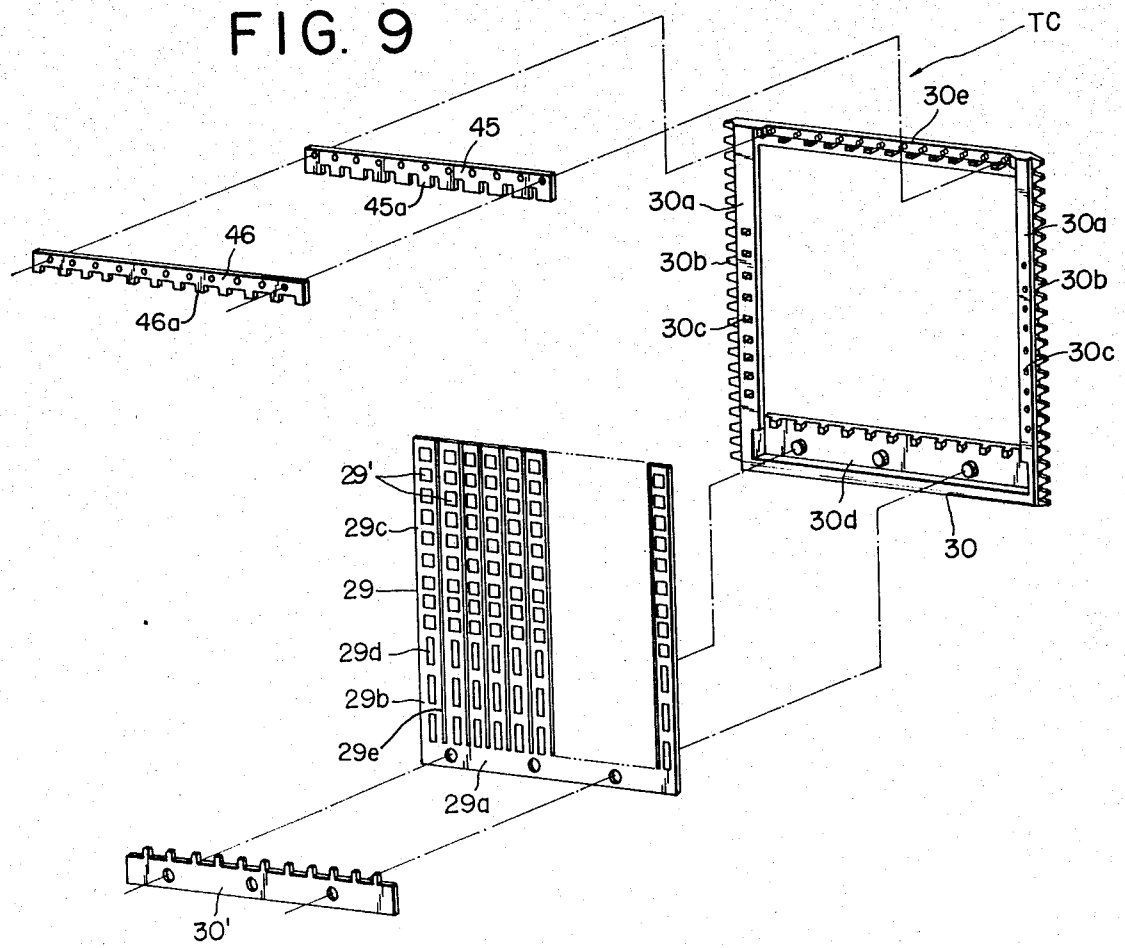
FIG. 9 is an exploded perspective view of a type carrying element.

Referring to FIG. 9, there is illustrated an example of a type carrying element employed in the typewriter according to the present invention. The type carrying element, generally designated at TC, includes a type plate 29 and a frame 30. The plate 29 has a substantially rectangular configuration and is made of a sheet of a rigid material having a predetermined elasticity, such as plastics or metals. The type plate 29 has character types 29' (see also FIG. 12) arranged in rows and columns on one face thereof. The types 29' may be made of a suitable plastics material and molded integrally on the type plate 29. Each type 29' has a portion extending from the opposite face of the type plate 29 through an opening formed in the finger 29*c*. This portion or extension has a horizontally extending wedge-shaped projection 29' which has a complementary configuration relative to a recess 59' formed at an end of the hammer 59 so that, when it is struck by the hammer 59, the character type 29' will be assuredly positioned for the vertical direction by operative engagement of the projection 29'' with the recessed end of the hammer 59. The type plate 29 has slits 29*e* which extend from the top edge to a portion near the botom edge thereof to separate the columns of the character types 29' from one another and define fingers 29*c* each having a column of the character types 29' thereon. Thus, the type plate 29 presents a substantially comb-like configuration as seen in FIG. 9. Each finger 29*c* carries the types 29' at an upper part thereof and has a few vertcially extending slits 29*d* formed in a lower part 29*b* thereof for attaining a suitable flexibility to the finger 29*c*. In the embodiment shown, the type plate 29 has up to twelve fingers 29*c* each carrying up to nine character types 29' thereon: thus, each type plate 29 may include up to 108 types 29' carried thereon, while the number of the fingers 29*c* and the number of the characters carried on each finger 29*c* may be arbitrarily varied otherwise.

The type carrier frame 30 is substantially in the form of a rectangular plate which has a large rectangular opening or window formed therein, leaving left and right side bars 30*a*, a lower cross bar 30*d* and an upper cross bar 30*e* contained in a same plane. Each side bar 30*a* has a toothed rack 30*b* on an outer edge thereof and has a plurality of (nine in the embodiment) round throughholes 30*c* formed therein in the same spaced relationship with the character types 29' in a column. The holes 30*c* in one of the side bars 30*a* may be elongated in a horizontal direction, as seen in FIG. 9.

Figure 12:
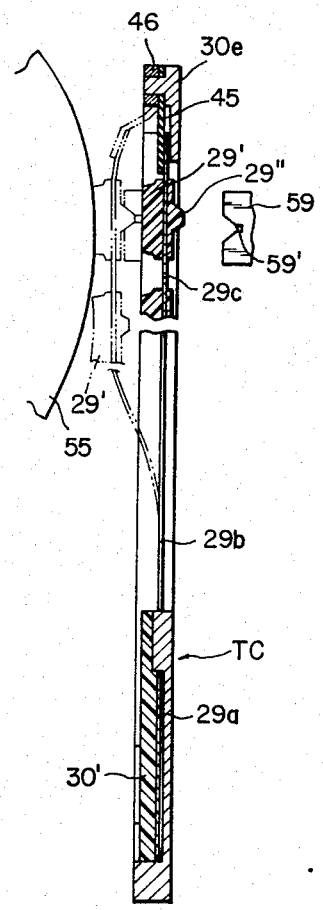
FIG. 12 is an enlarged sectional view of a type carrying element.

Referring to FIGS. 9 and 12, the type plate 29 is secured at its base portion 29*a* to the lower cross bar 30*d* of the frame 30 by means of an attaching plate 30' which may be riveted or secured by caulking to the lower crossbar 30*d* of the frame 30. Meanwhile, the type plate 29 is connected at the top end thereof to the upper cross bar 30*e* of the frame 30 by means of a rubber plate 45. In particular, the rubber plate 45 has a plurality of depending fingers 45*a* which correspond to the fingers 29*c* of the type plate 29 and have their lower ends adhered to the top ends of the type plate fingers 29*c*. The rubber plate 45 is secured at its base portion to the frame upper cross bar 30*e* by means of an attaching plate 46 which may be again riveted or secured by caulking to the cross bar 30*e*. The attaching plate 46 has a plurality of shorter fingers 16*a* for individually holding the fingers 45*a* of the rubber plate 45. Thus, if even a character type 29' which is located at the uppermost postion of a finger 29*c* is struck at the extension 29'' thereof by the hammer 59, the finger 29*c* carrying the type 29' thereon will be deformed or flexed toward the platen 55 sufficiently to allow the character type 29' to be struck against the platen 55, as seen in FIG. 12, thereby allowing clear printing of the character on a record medium 55*b* on the platen 55.

The printing mechanism according to the present invention includes a plurality of, for example, 20, such type carrying elements TC. In the printing mechanism, the type carrying elements TC are arranged in substantially equally spaced, parallel, vertical planes which are in parallel with the axis 55*d* of the platen 55 and in alignment with each other in a direction perpendicular to the planes. The type carrying elements TC are normally disposed below the platen 55. Thus, when a character is to be selected, the type carrying elements TC are first moved in the direction (hereinafter referred to as the "Z" direction) perpendicular to their planes to bring a type carrying element TC having the intended character type 29' thereon to a particular position (selection of a type plate 29) and then, the selected type carrying element TC is moved in the horizontal direction (hereinafter referred to as the "X" direction) in its plane to bring a column including the character type 29' to a second particular position (selection of a column), and finally, the type carrying element TC is lifted in the vertical direction (hereinafter referred to as the "Y" direction) in the plane to bring to a row including the character type 29' to a predetermined vertical position, i.e., to bring the character type 29' to a print position opposing to the hammer 59 (selection of a row). In this way, a character is selected by three dimensional movements of a type carrying element TC.

Figure 4:
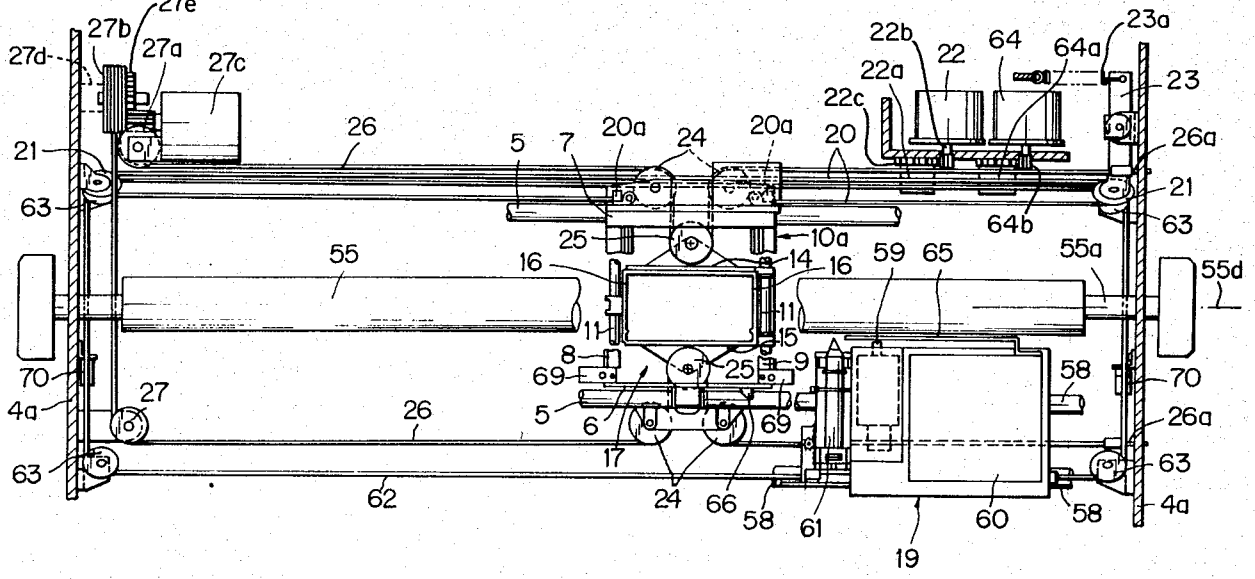
FIG. 4 is a plan view of the printing mechanism, partly broken, showing mechanisms for moving a hammer carrier and outer and inner sections of the type plate carrier.

Referring to FIGS. 2 and 4, the type carrier 10 includes an outer or base section, generally designated at 10*a*, and an inner section, generally designated at 17. The outer carrier section 10*a* has a framework including a front member 6, a rear member 7 and left and right side members 8 and 9, respectively. The front and rear members 6 and 7 are fitted on a pair of parallel rods 5 which extend across the machine between left and right side walls 4*a* of a machine frame 4 so that the type carrier 10 can move across the machine in parallel with the platen 55, i.e., in the X direction. The platen 55 is mounted for rotation on the sidewalls 4*a* by means of a platen shaft 55*a*.

The inner carrier section 17 has a framework including a front wall 14, a rear wall 15 and left and right side walls 16. The right side wall 16 has front and rear projections 16*c* each having a hole 16*e* formed therein while the left side wall 16 has a center projection 16*d* having a recess formed therein. A pair of rods 11 extend through the recess in the left side wall projection 16*d* and the holes 16*e* in the right side wall projections 16*c*. The rods 11 are supported at opposite ends thereof by the front and rear members 6, 7 of the outer carrier section 10*a* and located below the side members 8, 9. A pair of bushes 13 are secured to the right side wall 16 adjacent the projections 16*c* and slidably fitted on the right rod 11 so that the inner carrier section 17 can move along the rods 11 in the horizontal direction perpendicular to the X direction, i.e., in the Z direction. A cover 18 is mounted on the right side wall 16 to cover the bushes 13.

FIG. 4 shows mechanisms for moving the type carrier 10 in the X direction, for moving the inner carrier section 17 in the Y direction on the outer section 10*a* of the type carrier 10, and for moving the hammer carrier 19 in the X direction. The mechanism for moving the type carrier 10 includes a wire 20 which has opposite ends thereof secured to the rear member 7 of the outer carrier section 10*a* as at 20*a*. The wire 20 is stretched around and between pulleys 21 mounted on the left and right side walls 4*a* of the frame 4 and has an intermediate portion wound in several turns about a driving pulley 22*a* which is connected to an output shaft 22*b* of a driving motor 22 via a gearing 22*c*. Accordingly, when the motor 22 is energized to rotate the pulley 22*a*, the first carrier 10 will be moved in the X direction. One of the pulleys 21 may be mounted on a spring-urged lever 23 so that the tension of the wire 20 may be adjusted by adjustment of the strength of the spring 23*a*.

On the other hand, the mechanism for moving the inner carrier section 17 in the Y direction on the type carrier 10 includes a wire 26 which has opposite ends thereof secured to the right side wall 4*a* of the frame 4 as at 26*a*. The mechanism further includes two pairs of pulleys 24 mounted on forward and rearward extensions of the front and rear members 6, 7 of the outer carrier section 10*a*. The paired pulleys 24 on each extension are spaced from each other in the X direction, and another pulley 25 is disposed between the pulleys 24 in each pair in the X direction. The pulleys 25 are mounted on forward and rearward extensions of the front and rear walls 14 and 15, respectively, of the inner carrier section 17. The mechanism further includes a pulley 27 mounted on the frame left side wall 4*a*, and another pulley 27*a* and a drive pulley 27*b* mounted on a bracket 27*d* (shown schematically) secured to the machine frame 4. The drive pulley 27*b* is connected to a drive motor 27*c* through a gearing 27*e*. The wire 26 has an intermediate portion thereof wound in several turns the drive pulley 27*b* and extends from the drive pulley 27*b*, passing around the pulley 27 or 27*a*, left ones of the pulleys 24 on the outer carrier section 10*a*, the pulleys 25 on the inner carrier section 17 and right ones of the pulleys 24, to the right side wall 4*a* of the machine frame 4. Accordingly, if the motor 27*c* is energized to rotate the drive pulley 27*b* to pull the wire 26 around the pulley 27, the inner carrier section 17 will be move forwardly of the machine in the Z direction on the outer carrier section 10*a*. On the contrary, if the motor 27*c* rotates in the opposite direction, the inner section 17 will be moved in the opposite rearward direction. It is noted that one of the pulleys 24, 25, 27 and 27*a* may be mounted for adjustment in order to attain adjustment of the tension of the wire 26 in a similar manner to the wire 20.

Figure 3:
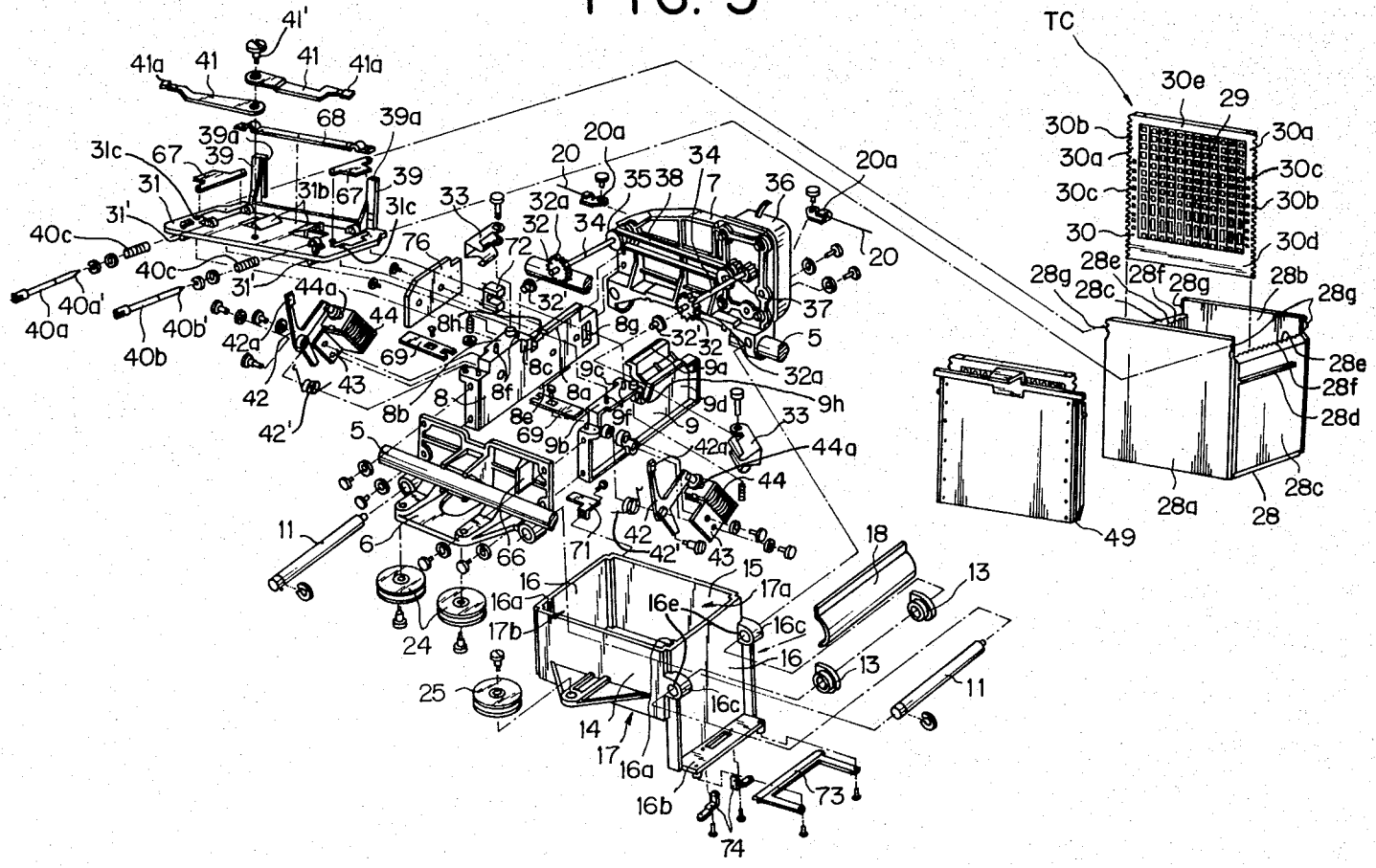
FIG. 3 is an exploded perspective view of a type plate carrier of the printing mechanism.
Figure 6:
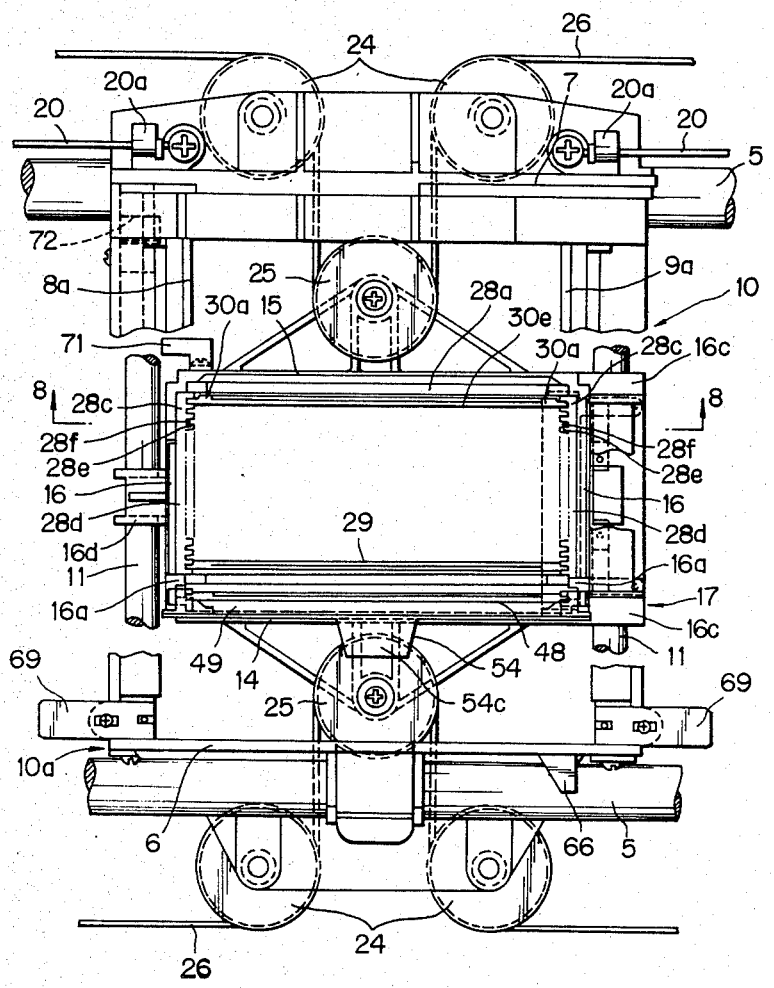
FIG. 6 is a similar plan view showing the inner and outer sections of the type plate carrier.
Figure 7:
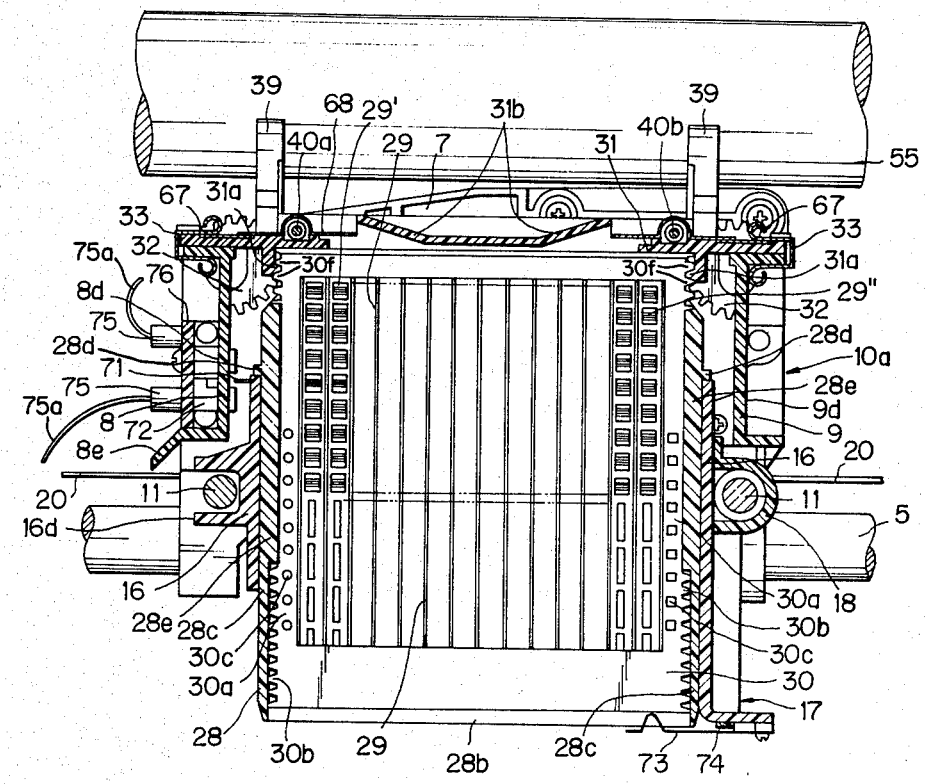
FIG. 7 is a sectional view taken along line 7—7 of FIG. 2.
Figure 8:
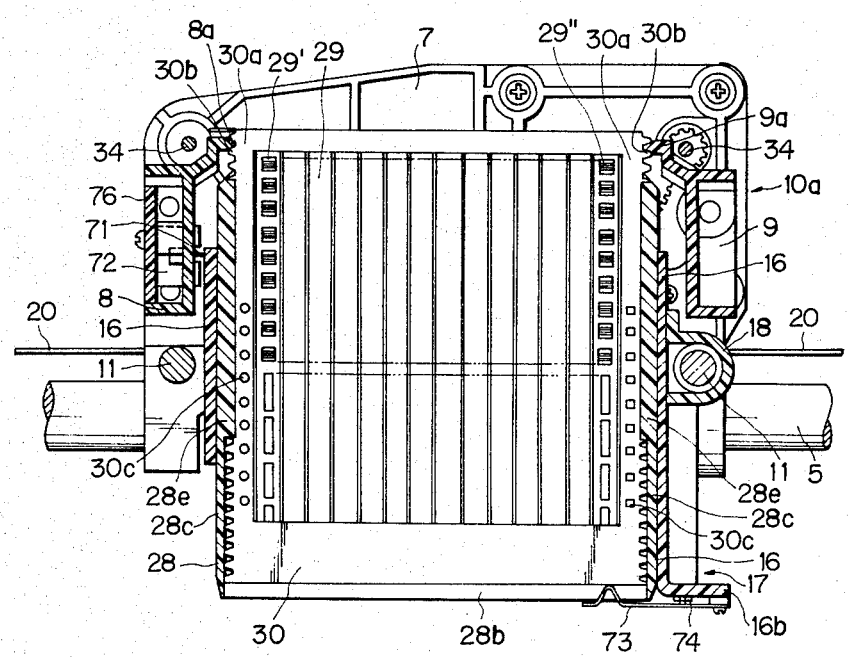
FIG. 8 is a sectional view taken along line 8—8 of FIG. 6.

Referring to FIGS. 3, 6 and 7, vertical ribs 16*a* are provided on the inner faces of the left and right side members 16 of the inner carrier section 17 and thus divide the inner section 17 into two potions, i.e., a type box receiving portion 17*a* and another section 17*b* for receiving an external type member, generally designated at 49. Inserted in the type receiving portion 17*a* is a type box 28 including a front wall 28*a*, a rear wall 29*b* and left and right side walls 28*c*. Projections 28*d* are provided on outer faces of the side walls 28*c* for engagement with upper edges of the left and right side walls 16 of the inner carrier section 17 when the type box 28 is inserted into the type box receiving portion 17*a* to vertically position the type box 28 with respect to the inner carrier section 17.

A plurality of vertical parallel ribs 28*e* are formed on inner faces of the side walls 28*c* of the type box 28 to define grooves 28*f* therebetween such that type carrying elements TC are each received in opposing ones of the grooves 28*f* of the type box side walls 28*c*, as seen in FIG. 6, to thus allow the type carrying elements TC to be held in equally spaced parallel planes which are also parallel to the axis of the platen 55 in a manner as described hereinabove.

A top plate 31 is normally located above the type box 28 received in the portion 17*a* of the inner carrier section 17. The top plate 31 has a pair of depending ribs 31' formed on the bottom thereof and extending in parallel relationship to the side walls 16 of the inner carrier seciton 17. An inner projection 31*a* is formed on the lower end of each rib 31' along the whole length thereof and has a configuration adapted for engagement with a recess between teeth 30*f* of the rack 30*b* of a type carrying element TC. Thus, all the type carrying elements TC are normally supported by the rib projections 31*a* of the top plate 31 which each extend between uppermost two adjacent teeth 30*f* of the type carrying elements TC, as seen in FIG. 7.

Means is also provided on the type box 28 for supporting the type box 28 in cooperation with the rib projections 31*a* of the top plate 31. In particular, the front and rear walls 28*a*, 28*b* of the type box 28 extend upwardly above the side walls 28*c*, and two teeth 28*g* are formed adjacent the top of each edge of both walls 28*a*, 28*b*. The teeth 28*g* have substantially the same configuration with the teeth 30*f* of the type carrying element TC, and when the inner carrier section 17 is in its home position, i.e., in a position nearest to the front member 6 of the outer carrier section 10*a*, all of the teeth 28*g* of the front and rear walls 28*a*, 28*b* are engaged with the rib projections 31*a* of the top plate 31. Accordingly, lifting of the top plate 31 would lift the type box 28 with the type carrying elements TC accommodated therein.

The top plate 31 is supported on mounting surfaces 8*b*, 9*b* formed on upper ends forwardly of the left and right side pieces 8, 9, respectively, and projections 8*f*, 9*f* are provided on each of the mounting surfaces 8*b*, 9*b*. When the type box 28 is in position in the type box receiving portion 17*a*, the projections 8*f*, 9*f* are fitted in holes 31*c* which are formed in opposite side portions of the top plate 31. Latch or clip members 33 made of a conductive elastic material are pivotally mounted at portions rearwardly of the mounting faces 8*b*, 9*b* of the side members 8, 9. These latch members 33 are adapted to hold the top plate 31 in position on the outer carrier section 10*a*. When the latch members 33 are in pivoted unlatching position, the top plate 31 can be removed from the top of the carrier 10 together with the type box 28 having type carrying elements TC accommodated therein. To facilitate such removal, the top plate 31 has knob means 31*b* provided thereon.

At the top of a portion of each of the side walls 8, 9 of the outer carrier section 10*a* behind the top plate 31, an inward projection 8*a* or 9*a* is provided which has a similar configuration to and is in alignment with either of the projections 31*a* of the top plate 31 so that the type carrying elements TC can move along a path defined by the projections 31*a* and 8*a*, 9*a* of top plate 31 and the side members 8, 9 of the carrier section 10*a*, respectively. Thus, the projections 31*a* and 8*a*, 9*a* serve as rail means for the type carrier elements TC, for the type box 28, and hence for the innner carrier section 17.

Each of the side members 8, 9 of the outer carrier section 10*a* has a slit or spacing 8*h*, 9*h* formed at the top centrally thereof. The projection 8*a* or 9*a* and the associated projection 31 are also spaced from each other by the same distance as the width of the slit or spacing 8*n*, 9*n*. Lift gears 32 are rotatably disposed within the spacing 8*a*, 9*a* (see also FIG. 5) such that, when they are in their home position, one of teeth 32*a* of each lift gear 32 is positioned in register with and contiguous to the associated projections 31*a* and 8*a*, 9*a*. Thus, the aforementioned rail means are completed each by a tooth of the lift gear 32.

Each lift gear 32 is secured to a shaft 34, a rear end of which is rotatably supported on the rear member 7 while a front end thereof is rotatably supported on the left and right side members 8, 9 of the outer carrier section 10*a* through buses 32'. A pulley 35 is mounted on the rear end of one of the shafts 34 while another pulley 37 is mounted on an output shaft 36*a* of a drive motor 36 secured to the rear member 7 of the out carrier section 10*a*, and a belt 38 is stretched between the pulleys 35 and 37. The other shaft 34 is connected to the motor shaft 36*a* through a gearing 36*b*. Accordingly, when the drive motor 36 is energized, both lift gears 32 are rotated synchronously through such transmission means. Thus, if a type carrying element TC has the racks 30*b* thereof meshed with the lift gears 32 when the motor 36 is energized, it will be lifted or lowered thereby.

Disposed above the lift gears 32 are type plate guides 39 which extend vertically from the top plate 31. Each type plate guide 39 has a guide groove 39*a* formed along the inner face thereof and adapted to receive therein a portion of rack 30*b* of a type carrying element TC to guide the element TC for vertical up and down movement. The grooves 39*a* and the lift gears 32 thus define a plane in which a type carrying element TC is moved up and down for selection of a row of character types 29' thereon.

Figure 5:
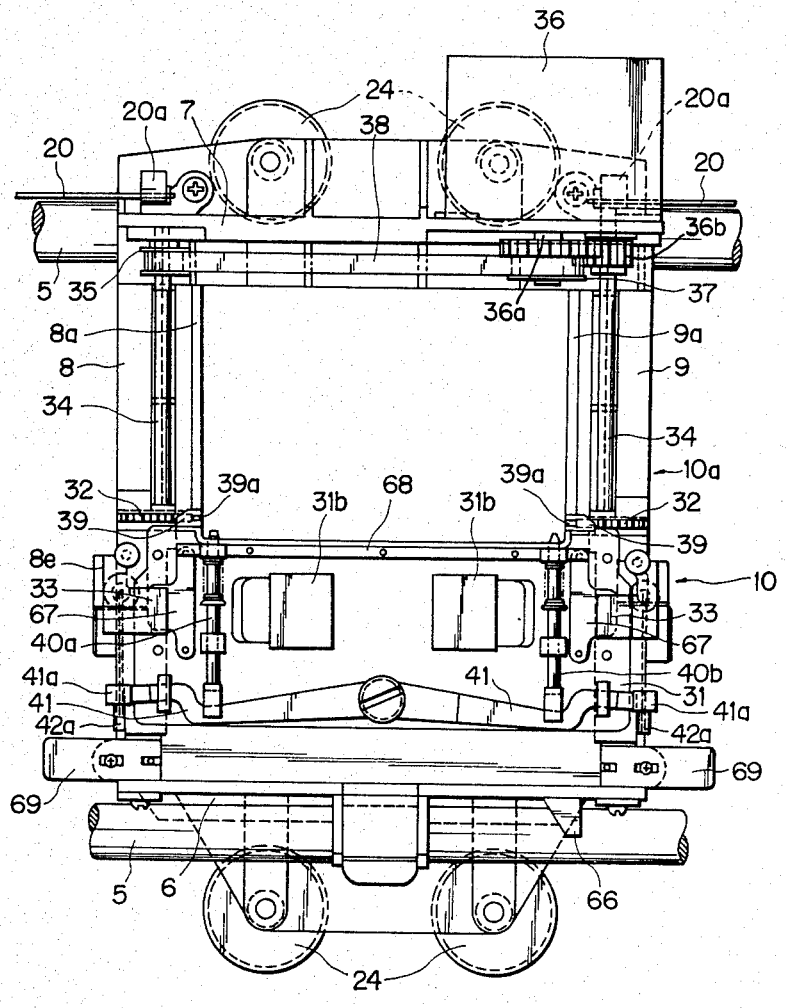
FIG. 5 is an enlarged plan view showing the type plate carrier.

Referring now to FIGS. 3 and 5, lock pins 40*a* and 40*b* are disposed on the upper surface forwardly of the type plate guides 39 of the top plate 31 and mounted for sliding axial movement in the back and forth or Z direction. The lock pins 40*a*, 40*b* are biased by means of springs 40*c* in a counter-locking direction with respect to the type carrying elements TC. A pair of lock levers 41 are each mounted for rotation on a common shaft 41' and are normally opposed at intermediate portions thereof to the forward ends of the lock pins 40*a*, 40*b*. Spring-urged pivotal lock cranks 42 (by springs 42') are mounted on portions 8*d* and 9*d* of the left and right side members 8, 9 of the outer carrier section 10*a*. Each of the lock levers 41 has a free end 41*a* thereof opposed to an end 42*a* of an arm of the corresponding lock crank 42 so as to allow engagement therebetween. Solenoids 44 are each mounted on a bracket 43 secured to the portion 8*d*, 9*d* of the side member 8, 9. The lock cranks 42 are connected individually to plungers 44*a* of the solenoids 44.

Accordingly, when the solenoids 44 are excited and the plungers 44*a* are withdrawn, the lock cranks 42 are rotated against the biasing force so that the ends 42*a* of the lock cranks 42 will be engaged with and push the ends 41*a* of the lock levers 41 to rotate the lock levers 41 to slidably move the lock pins 40*a*, 40*b* against the biasing force to a position where the rear ends 40*a*' and 40*b*' thereof are projected through the plane including the lift gears 32 as described hereinabove. Thus, if a type carrying element TC is in a lifted position within the plane, the lock pin ends 40*a*', 40*b*' will each be fitted into and extend through one of the holes 30*c* in the side bars 30*a* of the frame 30 of the type carrying element TC thereby to lock the type carrying element TC in the lifted position. Then, if the solenoids 44 are deexcited, the lock pins 40*a*, 40*b*, lock levers 41*a*, 41*b* and lock cranks 42 will be returned to their original positions by their associated springs 40*c* and 42' and the ends 40*a*', 40*b*' of the lock pins 40*a*, 40*b* will be moved away from the engaging holes 30*c* to thereby release the aforesaid locking action. The end 40*a*' of the lock pin 40*a* is in the form of a conical configuration whereas the end 40*b*' of the lock pin 40*b* is in the form of a pyramid while the engaging holes 30*c* of the side frame 30*a* corresponding thereto are respectively in the form of a circle and a square. As for the square engaging hole 30*c*, however, it has an allowable dimension in a lateral direction to thereby prevent said locking action from being failed due to any irregularity of dimensions.

Referring again to FIG. 4, the hammer carrier 19 is mounted for slidable lateral movement on a pair of guide rods 58 extending between the side walls 4*a* of the machine frame 4. A wire 62 is secured at opposite ends thereof to opposite sides of the hammer carrier 19. The wire 62 is stretched between left and right pulleys 63 mounted on the side walls 4*a*, and a portion halfway of the wiere 62 is wound in several turns about a driving pulley 64*a* which is connected to a hammer carrier driving motor 64 through a gearing 64*b*. Accordingly, as the motor 64 is engergized, the hammer carrier 19 will be moved laterally to bring the hammer 59 thereon to a print position. The adjustment of tension of the wire 62 of the hammer carrier 19 may be effected by means similar to that for adjustment of the tension of the outer or inner carrier section 10*a* or 17.

It is to be noted that either a stepping motor or a servor motor may be employed for the motors 22, 27*c*, 36 and 64 in the printing mechanism according to the present invention.

The hammer carrier 19 further has carried thereon a cassette ribbon device 60 and a marking device 61. A ribbon guide 65 is provided on the cassette ribbon device 60. A projection 66 is provided on the front member 9 of the outer carrier section 10*a* for engagement with the hammer carrier 19 to prevent the ribbon guide 65 from being impinged upon the type plate 29 and damaged due to the excessive movement of the hammer carrier 19 leftwards when the type plate 29 is selected and moved up.

Various electric detection means are provided on the typewriter. First, the top plate 31 has switch members 67 disposed on the upper surfaces on both sides thereof to contact with the stop or latch members 33 when the top plate 31 is placed in position on the mounting faces 8*b*, 9*b* of the left and right side members 8, 9 and held by the latch members 33, the switch members 67 being electrically connected to each other by means of a conductive member 68. Thus, if a circuit is established by the stop members 33, the switch members 67 and the conductive member 68, it may be indicated. If proper mounting of the type box 28 on the carrier section 17 has not been attained, then it will be indicated as such and thus machine operation will be inhibited.

Left and right sensor members 69 are provided to extend externally leftwardly and righwardly from the upper portions forwardly of the left and right side members 8, 9 of the outer carrier section 10*a*. These sensor members 69 cooperate with left and right X direction sensors 70 provided internally of the side walls 4*a*, and the left sensor 70 serves as a reference used to determine a home position at the initialization when a power supply is turned on, and under the conditions other than the above, the left sensor 70 serves to protect an overrun to left, whereas the right sensor 70 provides a reversing instruction signal to effect the leftward movement at the initial state, and under the conditions other than the above, the right sensor 70 is used to protect an overrun to right (FIG. 4).

At the rear of the rear wall 15 of the inner carrier section 17, a sensor member 71 is projectingly mounted on the side of the left side member 8 (FIGS. 2 and 7). This sensor member 71 cooperates with a Y direction sensor 72, which is fitted in a groove 8*g* bored in the left side member 8 and has a front portion projected towards a sliding plane of the sensor member 71, and when the inner carrier section 17 is moved towards the rear member 7 of the outer carrier section 10*a* after the power supply has been turned on and the sensor member 71 is crossed with the sensor 72, the inner carrier section 17 is moved reversely to its forwardmost home position.

On a lower portion 16*b* of the lower side of the right side portion 16 of the inner carrier section 17 are mounted a vertically movable sensor member 73 and two switch members 74 which constitute a normally closed switch. These elements are provided as safety measures, as well as for initialization, to prevent a breakage or a damage to apparatus resulting from the movement of the type plate 29 in the Z direction for printing when power fails or power supply is turned off due to an erroneous operation by an operator, etc., and the power supply is subsequently turned on to carry out the printing operation again, in case of the printing state wherein the type plate 29 is moved up to an printing position. When the power supply is turned on, the type carrier element TC is always excessively descended once from an ascended position (the state shown by the phantom lines in FIG. 11), whereby the vertically movable sensor member 73 is pressed by the lower end thereof to be moved away from the switch member 74, and in response thereto, the motor 36 is reversed to inversely operate the lift gears 32 so that the type carrier element TC may assume a home position.

Figure 10:
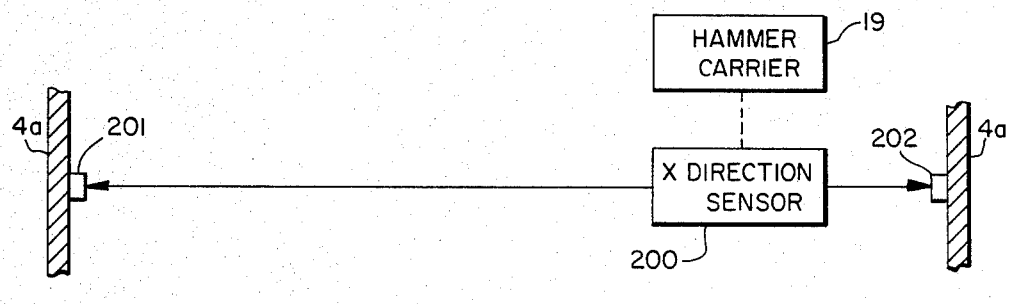
FIG. 10 schematically illustrates a sensor mechanism for the hammer carrier of the printer mechanism.

The Y direction sensor 72 is mounted on the left side member 8 through a printed circuit board 76 on which various connectors 75 or the like are provided. The left side member 8 is provided with a flared control portion 8*e* to prevent the occurrence of a phenomenon in which lead wires 75*a* drawn from the connectors 75 or the like come into frictional contact with the inner carrier section 17, resulting in trouble during the movement of the carrier 10. As schematically illustrated in FIG. 10, a sensor mechanism of the hammer carrier 19 is positioned opposite that of the case of the first carrier 10. That is, an X direction sensor 200 is provided on the hammer carrier 19, and left and right sensor members 201 and 202 are respectively provided internally of both the side frames 4*a*. When the power supply is turned on, the hammer carrier 19 is moved until the X direction sensor 200 reaches the left sensor member 201, which position is used as a reference, and the hammer carrier 19 is returned to its original position from the reference position and stops. The right sensor member 202 is provided to prevent an overrun.

In the present embodiment, the carrier sections 17 and 10*a*, the type box 28, the top plate 31, and the hammer carrier 19 are all formed of plastics to facilitate molding and render high speed operation resulting from the light-weight structure possible.

Figure 11:
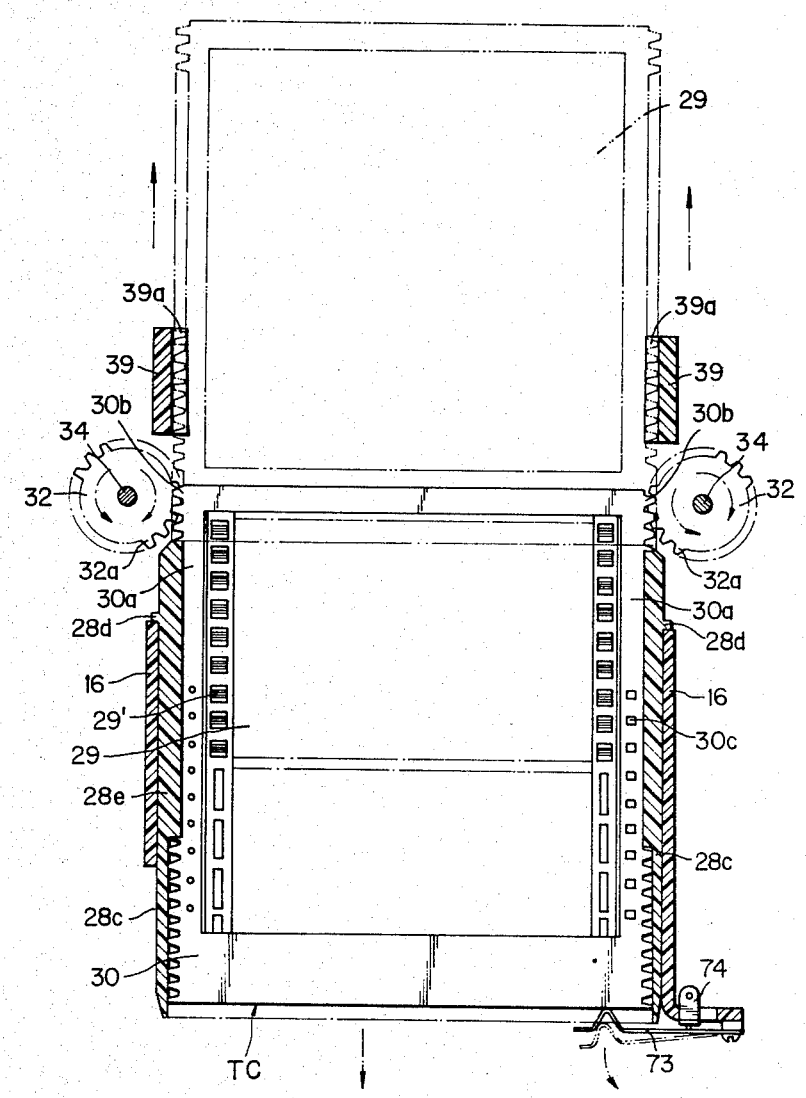
FIG. 11 is a sectional view, in diagrammatic representation, showing a type carrying element and lift gears in cooperating position.

Upon receipt of an input signal representative of a character to be printed, the motor 27*c* is first energized to move the inner carrier section 17 on the outer carrier section 10*a* in the Y direction to a position in which a particular type carrying element TC having a particular type of the character to be printed is in the predetermined plane defined by the lift gears 32 and the grooves 39*a* in the type plate guides 39 of the top plate 31. In this position in the particular plane, the type carrying element TC is supported on the lift gears 32 by engagement of the rack teeth of its rack 30*b* with teeth 32*a* of the lift gears 32, as seen in FIG. 11, while the remaining type carrying elements TC are supported by engagement of their rack teeth with projections 8*a*, 9*a* or 31*a* of the side members 8, 9 or the top plate 31, respectively. Either at the same time with or after the movement of the inner carrier section 17 in the Z direction, the motor 22 is energized to move the outer carrier section 10*a* leftwardly or rightwardly in the X direction to a position in which a type column including the particular type 29' is in register with the hammer 59 on the hammer carrier 19. After completion of the movements in the Z and X directions, the motor 36 is energized to lift the type carrying element TC in the Y direction to a position in which a type row including the particular type 29' is in register with the hammer 59. As a result, the type 29' of the character to be printed, i.e., the selected character type 29', is now in a position in register or alignment with the hammer 59. Then, the solenoids 44 are energized to axially move the lock pins 40*a*, 40*b* each into one of the holes 30*c* in the type carrying element TC thereby to lock the element TC to its lifted position. At the same time, a hammer solenoid 61 is energized to operate the hammer 59 to strike the aligned selected character type 29' to effect printing of the character.

After completion of printing, the solenoids 44 are deenergized to allow the lock pins 40*a*, 40*b* to be removed from the type carrying element TC, and then the motor 36 is energized again but reversely to move the type carrying element TC down in the Y direction beyond its normal vertical position until it is engaged with and brings the switch member 73 out of contact with the associated contact member 74 to render the switch off. In response to an electric signal from the switch, the motor 36 is reversed to lift the type carrying element TC to its original vertical position registered with the remaining type carrying elements TC. Then, the hammer carrier 19 is moved rightwardly in the X direction by one letter space distance by the motor 64, as in a conventional typewriter or printer. However, the inner and outer sections 17, 10*a* of the carrier 10 may remain at their respective positions until a subsequent next input signal is received, in order to eliminate unnecessary movements of the carrier 10. It is to be noted, however, that, when a next character type 29' is to be selected, the type 29' must be registered with the hammer 59 which is now displaced one character space distance from the position adjacent the last printed character; the "escapement" must be taken into consideration for proper movement of the outer carrier section 10*a*.

It is to be noted here that, upon initialization of the machine when the power is turned on, normally the motor 36 is first energized to move a type carrying element TC, which may be in any lifted position within the predetermined plane, down to its lowered and then up to its normal vertical position as in a manner described above, and then the remaining motors 27*c*, 22 and 64 are energized to once move the inner and outer carrier sections 17, 10*a* and the hammer carrier 19, respectively, to respective home positions, i.e., the forwardmost or leftmost positions, as in initialization of conventional typewriters or printers.

It is contemplated that various changes or modifications to the aforedescribed device may be made by one skilled in the art without departing from the basic concept of the present invention. For example, where a sufficient number of printing types can be contained within a type box and hence there is no necessity of exchanging the same for another type box containing, for example, different fonts therein, the type box and an inner carrier section may be formed as a single member or else the inner carrier section itself may contain all of required type carrying elements therein. Further, while the top plate for the type box of the embodiment has upright type plate guides and lock pins integrally mounted thereon, they may otherwise be mounted directly on the outer section of the print carrier.

Various other modifications, alternatives, variations, etc., to the embodiment of the printing mechanism of the present invention may become apparent to one skilled in the art without departing from the spirit and scope of the invention defined by the appended claims.

I claim:

1. A print carrier for a printer of the type wherein said print carrier is mounted for movement along a path in a first horizontal direction in parallel with an axis of a platen, comprising: a first section mounted for movement in the first direction; a plurality of substantially planar type carrying elements each having a plurality of character types arranged in rows and columns thereon; a second section mounted below said platen for movement on said first section in a second horizontal direction perpendicular to the first direction; a third section removably received in said second section and containing said type carrying elements in equally spaced parallel vertical planes which are parallel to said path; first rail elements secured to said first section; second rail elements removably mounted on said first section; said first and second rail elements providing a pair of rail means for supporting and guiding said third section and said type carrying elements for movement in the second direction at a predetermined vertical position; said third section being able to be removed, when supported on said second rail elements, together with said type carrying elements contained therein from said second section by lifting said second rail elements; means for fixing said second rail providing elements to said first section; and lifting means on said first section for lifting one of said type carrying elements which is in a predetermined vertical plane to a selected vertical position for printing.

2. A print carrier as claimed in claim 1, wherein said second rail elements include a plate member which has part of said rail means integral therewith.

3. A print carrier as claimed in claim 1, further comprising means on said first section for releaseably locking a type carrying element which is lifted to said selected vertical position.

4. A print carrier as claimed in claim 1, further comprising guide means mounted on said first section for guiding a type carrying element for vertical movement within said predetermined vertical plane.

5. A print carrier for a printer of the type wherein said print carrier is mounted for movement along a path in a first horizontal direction in parallel with an axis of a platen, comprising: a first section mounted for movement in the first direction; a plurality of substantially planar type carrying elements each having a plurality of character types arranged in rows and columns thereon; a second section for holding said type carrying elements in equally spaced parallel vertical planes which are parallel to said path, said second section being mounted below said platen for movement on said first section in a second horizontal direction perpendicular to the first direction; a pair of rail means on said first section for supporting and guiding said type carrying elements for movement in the second direction at a predetermined vertical position, each of said rail means being composed of a rail in two parts with a spacing left therebetween; and lifting means on said first section for lifting one of said type carrying elements which is in a predetermined vertical plane to a selected vertical position for printing, said lifting means including a pair of elements each of which corresponds to one of said rail means and which is disposed in said spacing between said two parts of the rail of the corresponding rail means and constitutes part of the corresponding rail means.

6. A print carrier as claimed in claim 5, wherein said elements of said lifting means are each a toothed gear, and each of said type carrying elements has a toothed rack formed at each of said edges thereof, whereby the toothed racks of a type carrying element in said predetermined vertical plane are meshed with the gears of said lifting means such that rotation of said gears will lift or lower the type carrying element.

7. A print carrier as claimed in claim 6, wherein said lifting means further includes a drive motor mounted on said first section and operatively coupled to said gears.

8. A type box assembly, comprising a housing having a first pair of opposing walls and a second pair of opposing walls interconnecting said first walls to define a spacing therein, said first walls having a plurality of parallel vertical grooves formed on opposing faces thereof, a plurality of substantially planar type carrying elements each having opposite side edges thereof received each in a pair of opposing ones of said grooves of said first walls, said type carrying elements carrying type which print upon impacting upon a printing mechanism, said second walls of said housing extending upwardly beyond said first walls and each having a recess formed at a portion adjacent the top end of each side edge thereof, a top plate, and a pair of parallel rail means integrally depending from said top plate and normally engaged in the recesses of said second walls of said housing to support said housing thereon, said side edges of each of said type carrying elements each having a recess formed at a position adjacent the top end thereof, said rail means being normally engaged also in the recesses of said type carrying elements thereby to support said type carrying elements for movement along rail means on said top plate.

9. A type box assembly as claimed in claim 8, wherein said top plate has a knob integrally formed thereon.

10. A type carrying member for use with a printing mechanism, comprising a frame having a pair of side bars and a pair of cross bars interconnecting said side bars at opposite ends thereof, said side and cross bars being disposed in a plane and defining therein a substantially rectangular window, a generally rectangular type carrying plate made of an elastic rigid material and having a base portion thereof secured to one of said cross bars of said frame, said plate having a plurality of fingers which extend from said base portion thereof within said window but are spaced from the other cross bar of said frame, a plurality of type blocks arranged in a column on and secured to each of said fingers of said plate such that said plate has type blocks arranged in rows and columsn thereon, and resilient means individually connecting ends of said fingers of said plate to the other cross bar and normally holding said fingers of said plate within said plane while allowing individual movement of said fingers laterally out of said plane.

11. A type carrying member as claimed in claim 10, wherein each of said side bars of said frame has a toothed rack formed along an outer edge thereof for meshing engagement with a toothed gear of said printing mechanism.

12. A type carrying member as claimed in claim 10, wherein each of said side bars of said frame has a row of perforations formed therein for engagement by a locking member of said printing mechanism.

13. A type carrying member as claimed in claim 10, wherein said resilient means is a rubber plate having a plurality of fingers individually connected to said fingers of said type plate.

14. A type carrying member as claimed in claim 13, wherein said resilient means is secured to the other cross bar of said frame by means of a plate member which has a plurality of shorter fingers for individually holding said fingers of said rubber plate.

15. A type carrying member as claimed in claim 10, wherein each of said fingers of said type plate has an elongated hole formed therein.

* * * * *